US006116717A

United States Patent [19]

Anderson et al.

[11] Patent Number: 6,116,717

[45] Date of Patent: Sep. 12, 2000

[54] METHOD AND APPARATUS FOR CUSTOMIZED CONTROL OF A PRINT CARTRIDGE

[75] Inventors: Frank Edward Anderson, Sadieville, Ky.; Paul Albert Cook; Thomas Jon Eade, both of Lexington, Ky.

[73] Assignee: Lexmark International, Inc., Lexington, Ky.

[21] Appl. No.: 09/153,726

[22] Filed: Sep. 15, 1998

[51] Int. Cl.[7] ..... B41J 29/393

[52] U.S. Cl. ..... 347/19

[58] Field of Search ..... 347/19, 14, 50, 347/49

[56] References Cited

U.S. PATENT DOCUMENTS

| | | | |
|---|---|---|---|
| 4,908,635 | 3/1990 | Iwasawa et al. | 347/14 |
| 5,017,948 | 5/1991 | Koizumi et al. . | |
| 5,083,137 | 1/1992 | Badyal et al. . | |
| 5,087,923 | 2/1992 | Bruch . | |
| 5,285,220 | 2/1994 | Suzuki et al. | 347/14 |
| 5,300,968 | 4/1994 | Hawkins . | |
| 5,321,427 | 6/1994 | Agar et al. . | |
| 5,363,134 | 11/1994 | Barbehenn et al. | 347/49 |
| 5,418,558 | 5/1995 | Hock et al. . | |
| 5,446,475 | 8/1995 | Patry . | |
| 5,473,356 | 12/1995 | Nisius et al. . | |
| 5,497,174 | 3/1996 | Stephany et al. . | |
| 5,610,635 | 3/1997 | Murray et al. . | |
| 5,646,660 | 7/1997 | Murray . | |
| 5,676,475 | 10/1997 | Dull . | |

*Primary Examiner*—John Barlow
*Assistant Examiner*—Charles W. Stewart, Jr.
*Attorney, Agent, or Firm*—Richard C. Stevens, Esq.; D. Brent Lambert, Esq.

[57] ABSTRACT

Mechanical and electrical characteristics of individual print cartridges are determined and used to generate control information for customizing control of each individual print cartridge. One or more characteristics including nozzle heater resistance, drop mass and drop velocity for individual print cartridges are determined and used to derive offset values for widths of pulses used to drive nozzle heaters in the individual print cartridges. While all three characteristics are preferably used, any one or two may also be used. Once determined, pulsewidths or offsets from nominal pulsewidths to improve or optimize printing using the print cartridges are stored in memory devices located on the print cartridges so that printers utilizing the print cartridges can retrieve the pulsewidth or offset data and utilize it in customizing or individualizing control of the print cartridges.

15 Claims, 5 Drawing Sheets

METHOD AND APPARATUS FOR CUSTOMIZED CONTROL OF A PRINT CARTRIDGE

FIELD OF THE INVENTION

The present invention relates in general to print cartridges for ink jet printers and, more particularly, to a method and apparatus for customized control of print cartridges wherein characteristics of each print cartridge are determined and stored on each cartridge so that ink jet printers utilizing the print cartridges can control the print cartridges in accordance with their individual characteristics to improve print quality.

BACKGROUND OF THE INVENTION

Noncontact ink jet printers control print cartridges inserted into the printers to eject droplets of ink from a plurality of ejection nozzles formed in printheads of the cartridges. Printheads are commonly formed using thin/thick film and integrated circuit technologies including etching and other well known processing techniques to operate on substrates made, for example, of silicon. The nozzles extend from nozzle chambers associated with heaters which, when activated, vaporize a portion of ink in the chambers to eject ink drops from the nozzles.

Manufacturing tolerances lead to mechanical and electrical variations in the printheads/print cartridges that affect formation of ink drops. Variations include differences in ink channel dimensions that affect ink flow, differences in nozzle chamber dimensions that affect vapor bubble formation, differences in nozzle dimensions that affect drop shape and velocity, and differences in heater and heater connection resistances that affect voltage requirements for effective heater activation.

These mechanical and electrical printhead/print cartridge variations can result in nonuniform ink ejection across printheads of print cartridges. The problems of nonuniform ink ejection due to such variations are increased as the size of the printhead assemblies increase to provide wider swath widths and faster print speeds. Accordingly, there is a need to compensate for mechanical and electrical variations to improve the uniformity of drops ejected from print cartridges and thereby the print quality produced by printers using the print cartridges. Preferably, the print cartridges would be individually characterized to enable printers using the cartridges to customize control of the cartridges based on their individual characteristics and thereby improve uniformity of ink ejection from the cartridges.

SUMMARY OF THE INVENTION

This need is met by the invention of the present application wherein mechanical and electrical characteristics of individual print cartridges are determined and used to generate control information for customizing control of each individual print cartridge. One or more characteristics including nozzle heater resistance, drop mass and drop velocity are determined and used to derive offset values for widths of pulses used to drive nozzle heaters in the individual print cartridges. While all three characteristics are preferably used to customize control of individual print cartridges, any one characteristic or any two characteristics may also be used to provide customized control for individual print cartridges. Once print cartridge characteristics have been determined, optimized pulsewidths or offsets from nominal pulsewidths which optimize printing using the print cartridges are derived and stored in memory devices located on the print cartridges. Printers utilizing the print cartridges can retrieve the optimization information and utilize it in controlling the print cartridges.

DETAILED DESCRIPTION OF THE PREFERRED EMBODIMENT

Reliable operation of ink jet nozzles depends upon providing adequate voltage to heater elements associated with the nozzles. It has been recognized in the prior art that a drop in voltage can occur due to simultaneously firing multiple heaters/nozzles and also due to higher resistances in electrical paths connecting firing pulses to heaters/nozzles and that voltage drops can result in improper ejection of ink droplets or failure to eject ink droplets at all. To correct for these problems, voltage drop compensation has been applied in the operation of ink jet printers.

In U.S. Pat. No. 5,497,174, it is disclosed that the voltage applied to individual heater elements of a printhead varies dependent on the position of the pulsed heater element on the printhead. Longer activation pulses are provided for heater elements which are more central on the printhead than for heater elements which are on the edge of the printhead. Thus, heater elements for a given printhead design are controlled in accordance with the geometry of the printhead design.

Memory has also been provided on print cartridges in the prior art. As disclosed in U.S. Pat. No. 5,610,635, a memory on a print cartridge is used for storing information about the cartridge, ink stored within the cartridge, and the types of printers with which the print cartridge can operate. For example, as disclosed in the '635 patent, the information includes ink type, ink color, lot number of the ink, date of manufacture of the cartridge, and data from a spectral analysis of the ink. A calculation, using an on-cartridge ink droplet counter, and storage of the initial amount of ink in the cartridge, the amount of ink delivered, and the amount of ink remaining in the cartridge, are also provided.

However, the use of memory on a print cartridge to store information permitting customized control of each print cartridge based on its individual mechanical and electrical characteristics has not been available until this time. In accordance with the present invention, each printhead is characterized and determined characteristics are used to provide customized information for control of each printhead by a printer utilizing the printhead. Thus, variations between different printheads of the same design are accommodated so that variations from printhead to printhead of the same design can be compensated to improve print quality.

Figure 1:
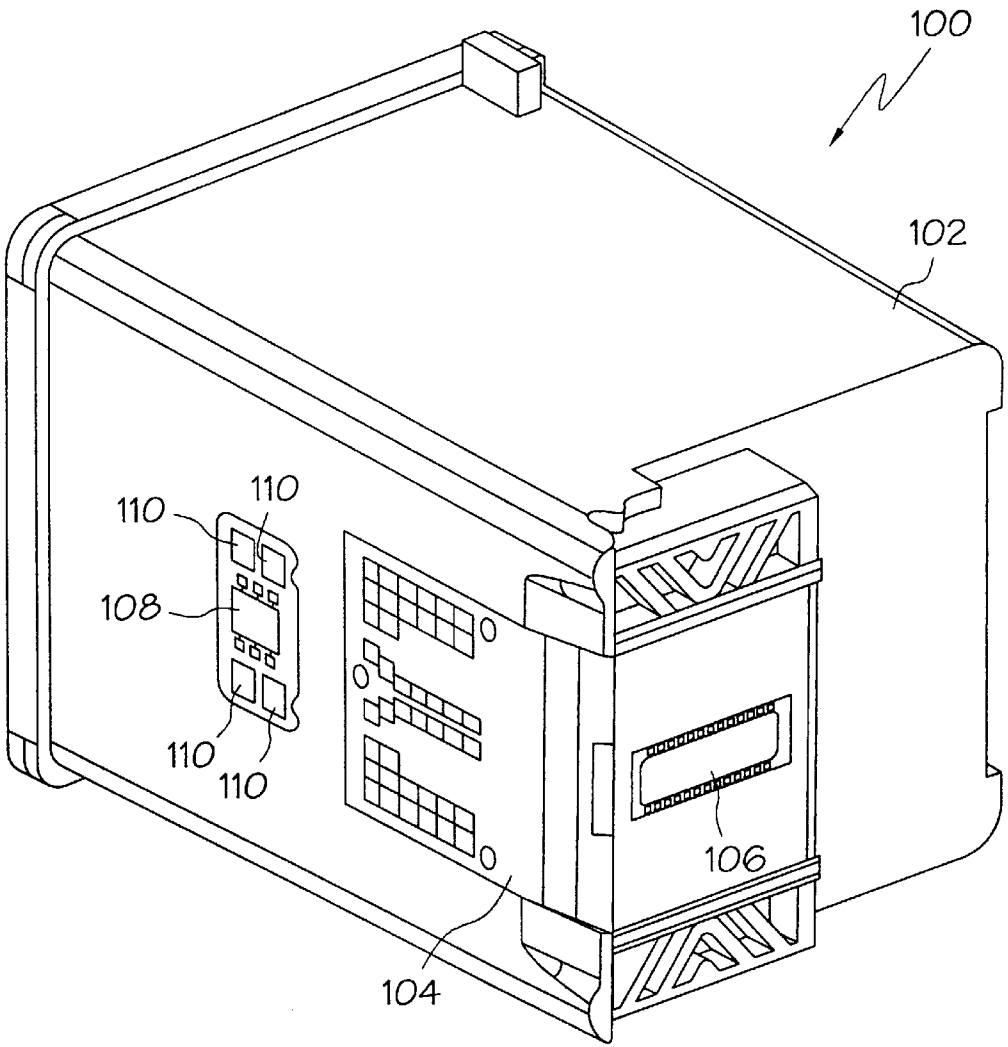
FIG. 1 is a perspective view of a portion of a disposable print cartridge including and operable in accordance with the present invention.

As shown in FIG. 1, a print cartridge 100 of the present invention includes a cartridge body 102, a TAB circuit 104 associated with a printhead 106, and a memory device 108 mounted on the cartridge body 102. A plurality of electrical contacts 110, four in the illustrated embodiment, are provided for access by a printer utilizing the print cartridge 100. While any appropriate memory device can be used in the present invention, a serial $E^2$PROM memory designated as an AT88SCC153 and commercially available from Atmel Corporation is currently preferred.

Figure 2:
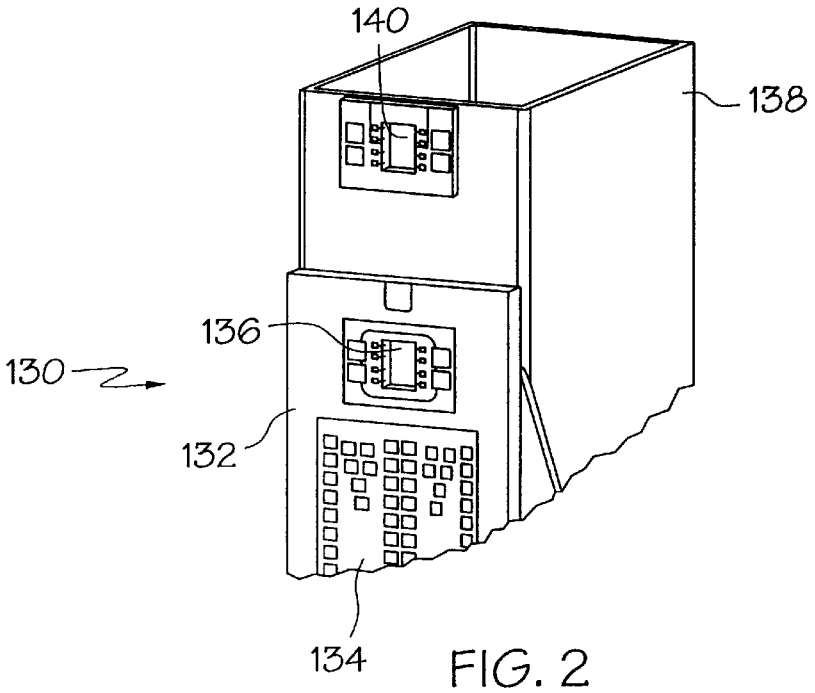
FIG. 2 is a perspective view of a portion of a refillable print cartridge including and operable in accordance with the present invention.

The print cartridge 100 of FIG. 1 is representative of use of the present invention with a common disposable print cartridge. Of course the present invention can also be used with refillable print cartridges. Such a refillable print cartridge 130 is illustrated in FIG. 2 wherein a primary printhead body 132 includes a printhead (not shown), a TAB circuit 134 and a memory device 136. While the primary printhead body 132 can be replaced if necessary due to failure, it is intended to remain installed in a printer for its entire lifetime.

A replaceable ink tank 138 is removably mateable with the primary printhead body 132 with the ink tank 138 being replaced as needed to replenish the ink supply for a printer utilizing the refillable print cartridge 130. The ink tank 138 is illustrated as also having a memory device 140 which may or may not be provided, as desired in a given application. Preferably, the memory device 140 is provided and used, for example, to store the amount of ink remaining in the ink tank 138. With this information, while a print tank may have sufficient ink remaining that it need not be discarded or refilled, it can be replaced with a tank having more ink for a large print job. Of course, the memory device 136 would have the customized information for the print cartridge 130 for control of the print cartridge by a printer utilizing the print cartridge.

As previously noted, manufacturing tolerances lead to mechanical and electrical variations in the printheads/print cartridges that affect formation of ink droplets. Variations include differences in ink channel dimensions that affect ink flow, differences in nozzle chamber dimensions that affect vapor bubble formation, differences in nozzle dimensions that affect drop shape and velocity, and differences in heater and heater connection resistances that affect voltage requirements for effective heater activation.

These mechanical and electrical printhead/print cartridge variations can result in non-uniform ink ejection across printheads of print cartridges. The problems of non-uniform ink ejection due to such variations are increased as the size of the printhead assemblies increase to provide wider swath widths and faster print speeds.

Figure 3:
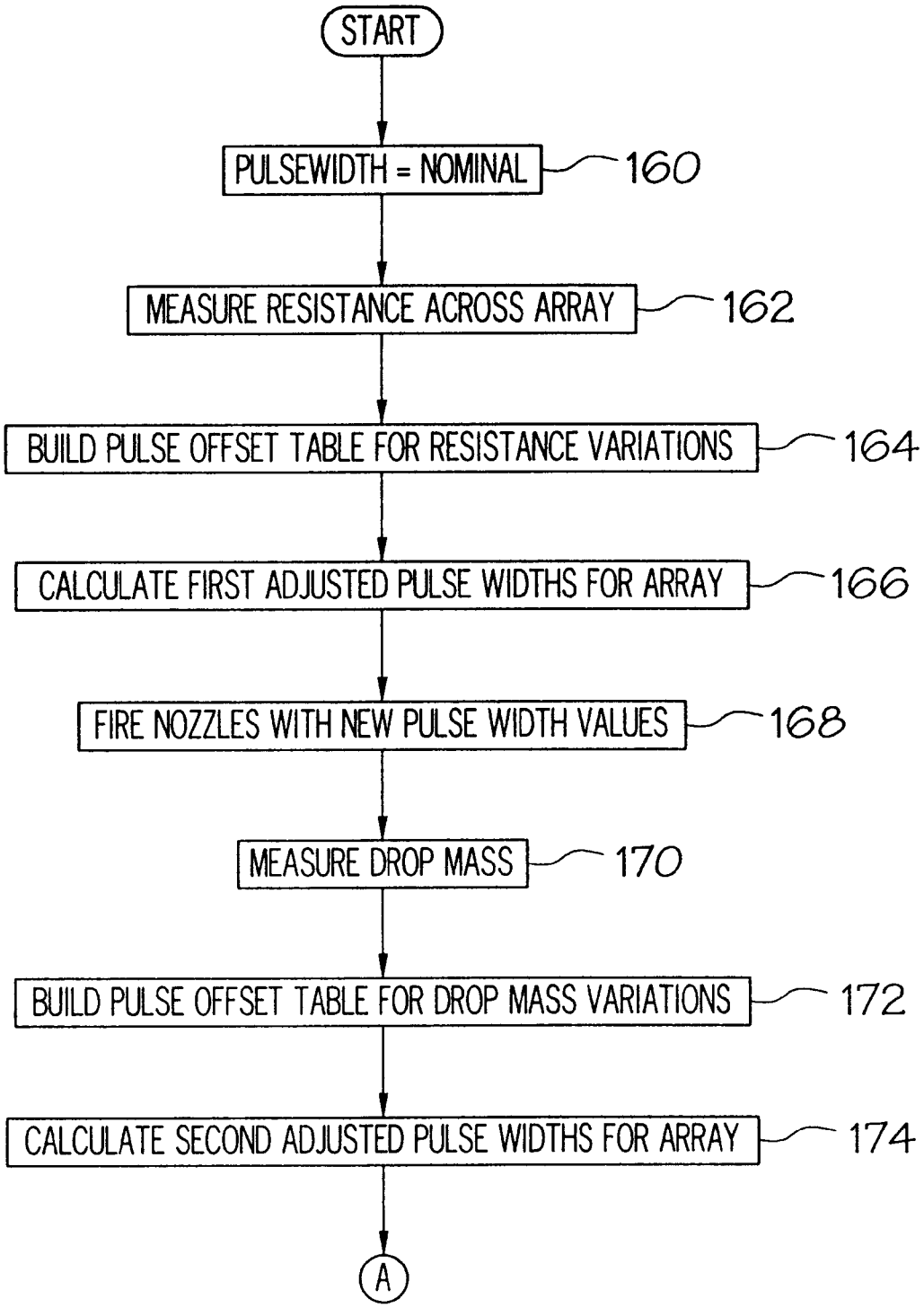
FIGS. 3 and 4 form a flowchart for characterizing print cartridges.
Figure 4:
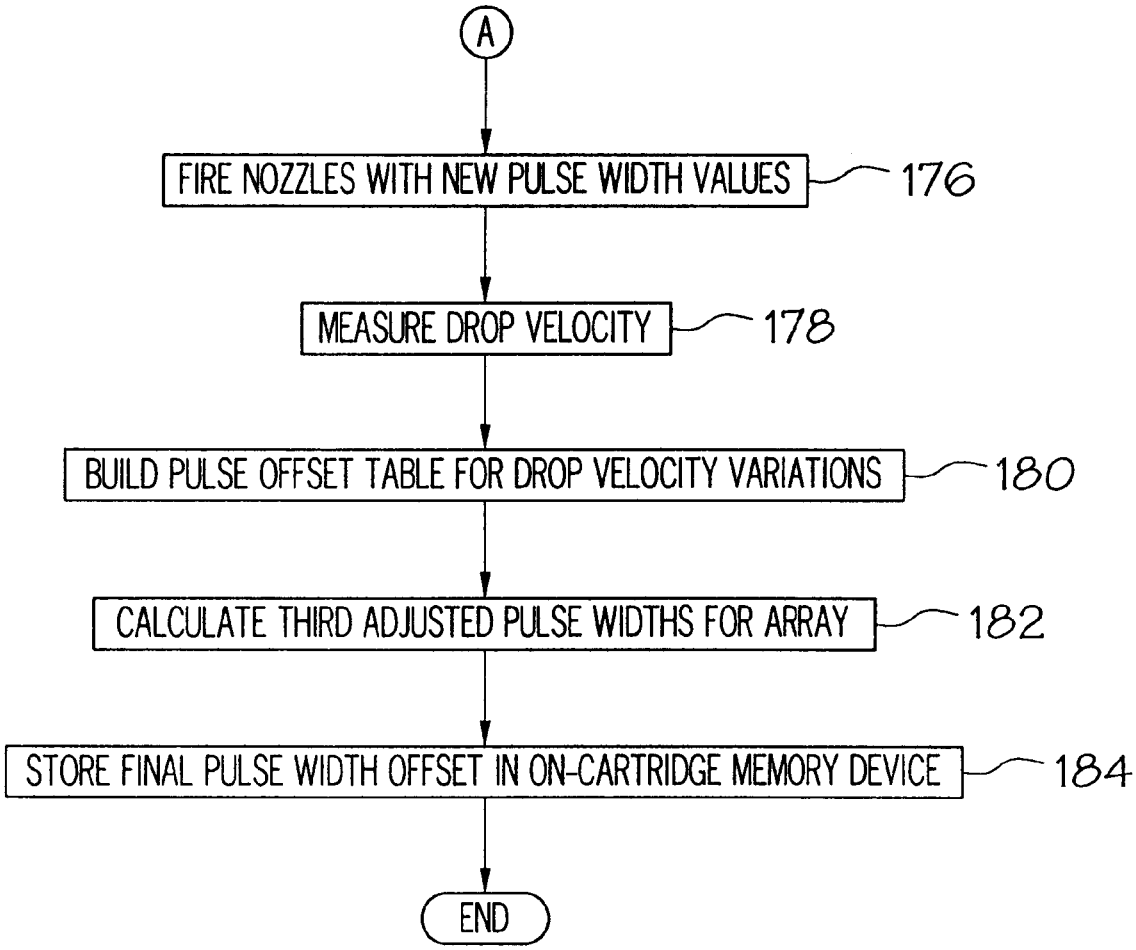

Reference will now be made to FIGS. 3 and 4 which form a flowchart for characterizing printheads. The characteristics of individual print cartridges determined using the process outlined by the flowchart are then used to determine control information specific to individual print cartridges. The resulting cartridge specific control information is stored in a memory device on each print cartridge. The stored control information is then used by an associated printer to compensate for mechanical and electrical variations to improve the uniformity of droplets ejected from print cartridges and thereby the print quality produced by printers using the print cartridges. In this way, print cartridges are individually characterized so that they can be custom controlled based on their individual characteristics and thereby improve uniformity of ink ejection from the cartridges.

The initial step in the characterizing process is to determine nominal widths of the pulses which should be provided to the heaters of a specific print cartridge design, see block 160. These values are based on the nominal design of the print cartridge. Accordingly, due to manufacturing tolerances, the pulsewidths which should be provided to the heaters of a print cartridge, groups of heaters of a printhead of a print cartridge or individual heaters of a printhead of a print cartridge for optimum droplet generation vary from nominal. The nominal pulsewidths are what are normally provided in conventional ink jet printers to control print cartridges. The nominal pulsewidths are calculated using voltage and current values to estimate the power transferred to ink in the nozzle chambers and typically vary from 0.5 microseconds to 2.5 microseconds. With a nominal voltage of 12 volts dc and a nominal current of 322 milliamps, the energy range is between 5 and 7 microjoules.

After nominal pulsewidths are determined, resistance measurements are made across the array of heater elements, see block 162, by measuring the resistance of paths through the array. For example, a fixed voltage can be applied while selectively enabling sections of the array one section at a time and measuring the current when a drop or drops are ejected from each section. This yields an ohmic value for each path through the array or section. It is to be understood that a path through the array can correspond to the entire array or a section of the array and, depending upon the storage capacity of the memory device being used, a section can be a single nozzle heater. While resistance measurements can be made in more than one way as will be apparent to those skilled in the art, it is preferred to make measurements from contact to contact for each section of the array on a fully assembled cartridge since this provides the most accurate resistance measurements.

An offset table is built based on the different resistance measurements in comparison to the nominal pulsewidths to adjust the pulse width for each section of the array as necessary to present the same energy to each of the nozzles, see block 164. Using the offsets, first adjusted pulsewidths based on the measured resistance values are then calculated for each section, see block 166. Higher resistance paths through the array will result in lower voltage at the heaters such that the energy transferred to a drop will be less for a given pulsewidth. Such paths can be compensated by increasing the duration or width of pulses to thereby increase the energy to the desired value.

Fire pulses can typically be adjusted in increments equal to one period of the master clock signal that drives the digital electronics of the printer. For example, a 20 Megahertz clock would result in adjustment resolution for the pulsewidths of 50 nanosecond increments. Here again, a section of the array can range from the entire array to groups of nozzle heaters of the array to a single nozzle heater. While offsets from nominal pulsewidths are currently preferred, the pulsewidths required for each print cartridge, sections (or groups) of heaters on a printhead of a print cartridge or individual heaters can also be determined and stored.

Once the resistance adjustments have been made, the electrical process variations are no longer a variable in consistency of drop production. Next, the nozzles on the printhead of the print cartridge are fired using the first adjusted pulsewidths determined from the resistance values, see block 168. The masses of the droplets resulting from this printhead operation are measured, see block 170, using known drop mass measurement techniques and apparatus including a fixture for electrical connection to and driving the print cartridge, an ink supply, a precision balance and a controller, and a second pulse offset table is built based on the drop mass variations, see block 172.

While it is possible to measure the mass of a single ink drop, it is not currently practical to do so for production of print cartridges since the target mass of a single ink drop is typically 10 to 20 nanograms. Such measurement would require expensive balance equipment and the tolerance for error would likely be unacceptable. Alternately, a drop mass measurement technique consists of firing a large number of drops from a nozzle or a group of nozzles and dividing the total accumulated mass by the drop count. Typical measurements use counts of 100,000 drops resulting in weights near 1.0 milligram. This technique can be applied to all sections of a printhead and mass values for each section are used to determine a pulsewidth offset to increase or decrease drop mass as necessary to achieve consistency across the array as will be described in more detail with regard to an example printhead characterization described hereinafter.

Second adjusted pulsewidths based on the drop mass variations are then calculated for each print cartridge, groups of heaters on a printhead of a print cartridge or individual heaters on a printhead of a print cartridge, see block 174. The new values for the fire pulses to compensate for circuit resistance variation and flow feature and nozzle chamber variation, i.e. the second adjusted pulsewidths, can now be used to fire the nozzles and test for drop ejection velocity, see block 176. The velocities of the droplets resulting from this printhead operation are then measured, see block 178, using known drop velocity measurement techniques and apparatus including a high intensity lamp that illuminates the drop stream as it passes in front of a pair of photosensors and a third pulse offset table is built based on the drop velocity variations, see block 180. As a drop crosses the first sensor, a high speed digital timer starts counting. When the drop passes the second sensor, the timer stops and a controller determines the drop velocity. This velocity measurement technique can be applied in turn to each section of the printhead to determine drop velocities for each section.

Figure 6:
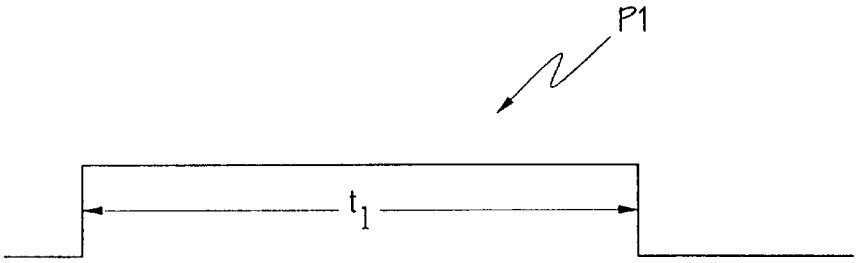
FIGS. 6 and 7 show two fire pulse diagrams.
Figure 7:
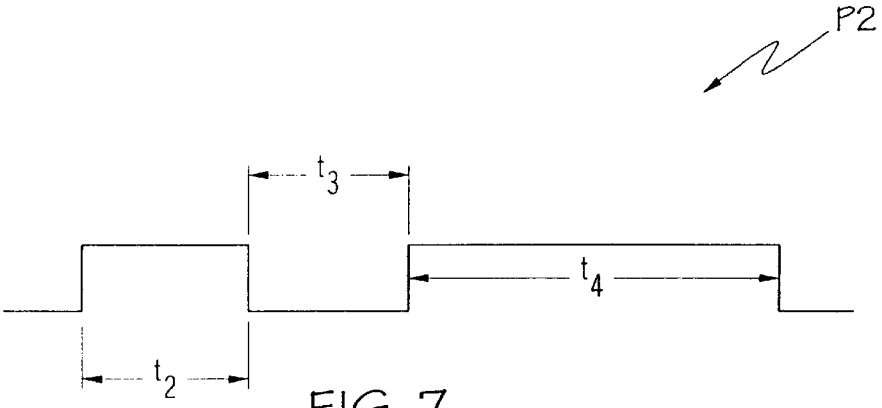

Third adjusted pulsewidths based on the drop velocity variations are then calculated for each print cartridge, groups of heaters on a printhead of a print cartridge or individual heaters on a printhead of a print cartridge, see block 182. The third or final adjusted pulsewidths can then be stored and used to control the print cartridge that has just been characterized. However, it is currently preferred to store the third or final pulsewidth offsets in the memory device for customized control of the print cartridge, see block 184. In either event, the pulsewidths or offsets are unique to the cartridge they are used to control Research has shown that drop mass and velocity can be controlled by the time displacement of the energy transfer to the ink while maintaining the same energy amplitude. Laboratory results using split fire pulses show that mass and velocity can be increased or decreased by changing the width of a pre-heat pulse and the off time between the pre-heat pulse and the main ejection pulse. FIGS. 6 and 7 show two fire pulse diagrams: a first traditional fire pulse P1 used to fire an ink drop and a second split fire pulse P2 with the same total energy but different timing characteristics, respectively. The sum of the times $t_2$ and $t_4$ in the second pulse P2 is equal to the time $t_1$ in the first pulse P1. This equality ensures that the total energy delivered remains constant. The pre-heat pulse during time $t_2$ heats the ink in the nozzle chamber but does not have sufficient energy to eject the drop. The off time $t_3$ allows the energy from the pre-heat pulse to distribute itself through the chamber. The main pulse $t_4$ then ejects the drop. Thus for a given nozzle chamber, a particular set of values for $t_2$, $t_3$ and $t_4$ can be determined to adjust the mass and ejection velocity to the desired value. An iterative process can be used while the print cartridge is attached to drop mass/velocity measurement equipment to determine the proper pulse shape for each nozzle or section of nozzles.

Figure 5:
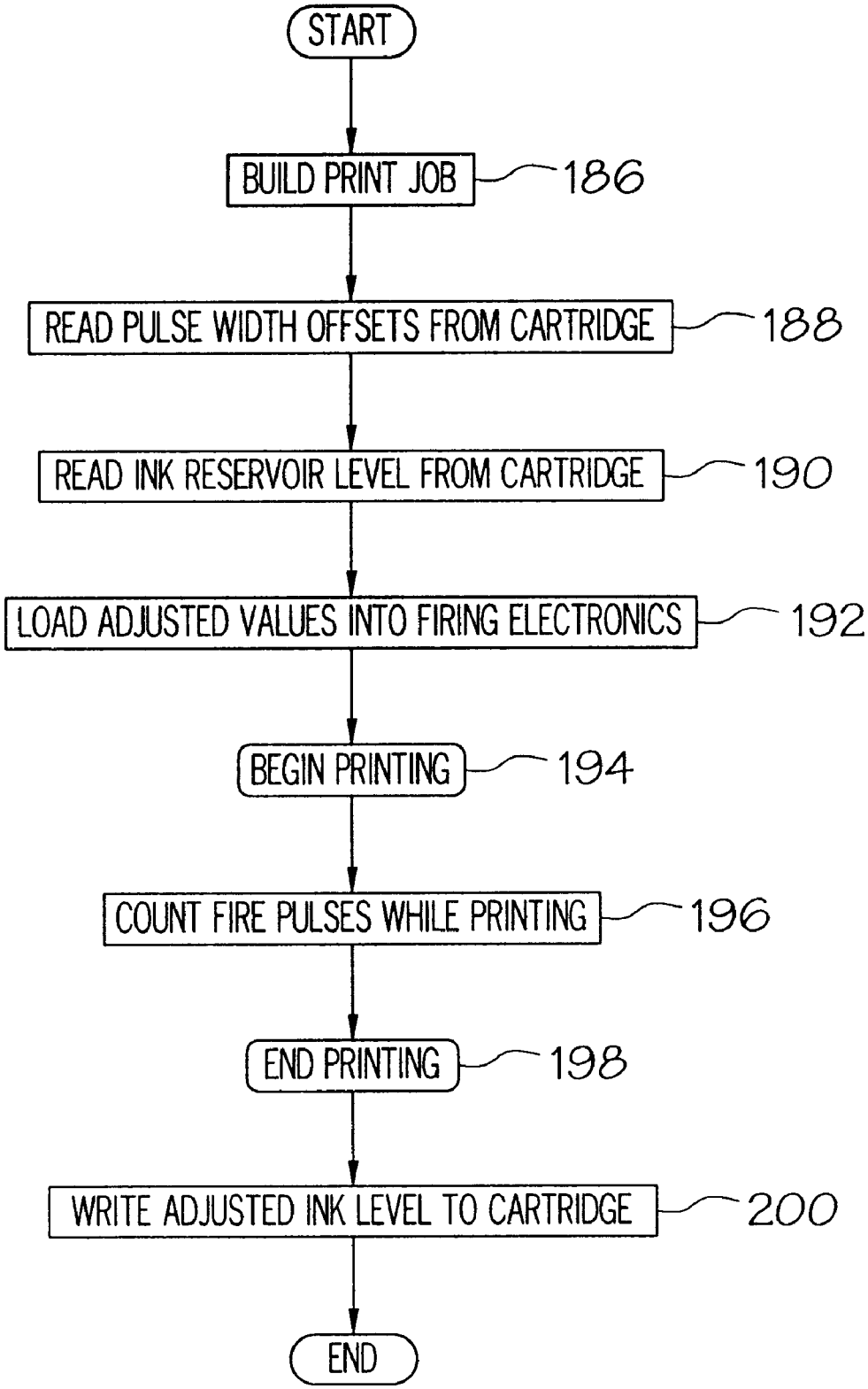
FIG. 5 is a flowchart for adjustments made during printing using print cartridges including the present invention.

Reference will now be made to FIG. 5 which is a flowchart for adjustments made during printing using print cartridges which have been characterized as described above relative to FIGS. 3 and 4. A printer utilizing a print cartridge of the present invention initially assembles or builds a print job, see block 186. The memory device including characteristics of the print cartridge is read to determine the pulsewidth offsets which optimize the print operation using the print cartridge, see block 188. The ink reservoir is next read from a memory device on the print cartridge, see block 190, either the same memory device or a memory device associated with a replaceable ink tank. The print job is then adjusted using the pulsewidth offsets which optimize the print operation using the print cartridge and the adjusted print job is loaded into firing electronics, see block 192. The print job is started, see block 194, and the fire pulses or drops are counted during the print job, see block 196. When the print job has completed, see block 198, the drop count is used to calculate the ink which was used for the print job and the ink level in the print cartridge or ink reservoir is determined and used to update the ink reservoir level information on the print cartridge or replaceable ink tank, see block 200.

With this understanding of the present invention, an example print cartridge characterization will now be described. The characterization process begins by establishing a nominal energy value to be delivered to the ink to eject a droplet from a chamber. For purposes of this example, a nominal pulse width of 1.6 microseconds divided into a 0.3 microsecond pre-heat pulse, a 0.9 microsecond off time and a 1.3 microsecond main pulse and a nominal heater resistance of 35.85 ohms will be used. Using a 12 volt de source results in a delivered energy of approximately 4.6 microjoules.

For the design of the example print cartridge, the range of heater resistance values has been measured to be between a maximum value of 39.48 ohms and a minimum value of 32.58 ohms. The resultant pulse width values for these extremes are 1.27 and 2.03 microseconds, respectively. Assuming a 20 Megahertz clock, the resolution of the firing electronics permits only units of 0.05 microseconds, these values will be rounded to 1.25 and 2.05 microseconds. For any resistance value measured, a linear interpolation between these points is used to determine a target pulse width.

Returning to our example print cartridge, an average resistance value of 34.87 ohms was measured for a given subsection of the nozzle heater array. Using the nominal value and the linear interpolation from the preceding paragraph, a new pulse width value of 1.7 microseconds or a delta to the starting pulse of 0.1 microseconds is determined. This delta will be stored as a count of +2 (representing two 0.05 microsecond increments) to be added to the main pulse. This step is repeated for each section of the nozzle heater array until the offset table is complete for the resistance compensation adjustments.

Next, the nozzles are fired on the drop mass measurement apparatus using the adjusted pulse widths from the previous steps. The values for mass are 35 nanograms maximum, 28 nanograms nominal and 22 nanograms minimum. This particular print head measured an average drop mass for one section of 32 nanograms. Since this number is higher than the desired nominal value of 28 nanograms, the fire pulse should be adjusted. To effectively eject the droplet from the nozzle chamber, the total energy delivered to the ink must not be less than the 4.6 microjoules discussed above. The drop mass, however, can be adjusted by changing the distribution of the energy between the pre-heat pulse and the main pulse. Thus, for this print head subsection with a measured mass 4 nanograms above nominal, we shift 0.1 microseconds from the main pulse to the pre-heat pulse, keeping the total energy delivered constant and decreasing the mass of the ejected droplets. This information will be stored in the table as a −2 delta count for the main pulse and a +2 delta count for the pre-heat pulse.

Next the nozzles from a section under test are fired with the combined offsets from the previous steps. The cumulative effect of the offsets results in a pre-heat time of 0.4 microseconds, an off time of 0.9 microseconds and a main pulse time of 1.3 microseconds. This pulse is applied to the section of nozzles while the print cartridge is affixed to the drop velocity measurement apparatus.

For this print head, drop velocity ranges from 500 to 700 inches per second (ips) with a nominal value of 600 ips. This section of nozzles has a measured velocity of 625 ips. The mass and ejection velocities are directly related. Both can be changed by the redistribution of energy between the pre-heat and main fire pulses. Since this head is slightly over nominal velocity, it is desired to reduce the drop velocity. This is accomplished in a manner similar to the drop mass adjustment. To slow the drop, energy is taken from the pre-heat pulse and added to the main pulse. The velocity delta of +25 ips results in a removal of 0.05 microseconds from the pre-heat pulse and a subsequent addition of the same time to the main pulse. This information is stored as a−1 delta for the pre-heat pulse and a +1 delta for the main pulse.

The final resultant offset table for the pulse applied to the example section is listed below. All times are in counts with each count representing 0.05 microseconds.

| | Pre-heat | Off Time | Main Pulse |
|---|---|---|---|
| Starting Value | +6 | +18 | +26 |
| Resistance Offset | +0 | +0 | +2 |
| Mass Offset | +2 | +0 | −2 |
| Velocity Offset | −1 | +0 | +1 |
| Resultant Total | +7 | +18 | +27 |

This final pulse is optimal across manufacturing process variations and will produce a droplet more consistent with those from the other sections of the array that will be adjusted in the same manner.

It is noted that individual print cartridges preferably are characterized for resistance, drop mass and drop velocity with the characterizations being used to determine customized control data, representing pulsewidths or offsets from nominal pulsewidths, which are stored in memory devices on the print cartridges so that a printer utilizing the cartridges can retrieve the customized control data for optimum control of the print cartridges. However, in accordance with the present invention, improved printer control of print cartridges can also be obtained by characterizing print cartridges for any one or two of these variables as well as all three.

Having thus described the invention of the present application in detail and by reference to preferred embodiments thereof, it will be apparent that modifications and variations are possible without departing from the scope of the invention defined in the appended claims.

What is claimed is:

1. A method for customizing control of a print cartridge to improve quality of print produced using said print cartridge which includes a cartridge body containing ink and a printhead secured to said cartridge body and defining ink ejection nozzles, said method comprising the steps of:

determining resistance values of nozzle control paths on said print cartridge, said nozzle control paths corresponding to said ink ejection nozzles of said printhead;

determining energy requirements for said ink ejection nozzles based on said resistance values so that ink is ejected substantially uniformly from said ink ejection nozzles;

determining the masses of droplets ejected from said ink ejection nozzles of said printhead in response to control signals based on said energy requirements;

determining revised energy requirements for said ink ejection nozzles based on the masses of droplets ejected in response to said control signals, said revised energy requirements making the masses of ink droplets ejected from said ink ejection nozzles substantially uniform; and storing said revised energy requirements as energy requirements specific to said print cartridge in a memory device mounted on said print cartridge.

2. A method for customizing control of a print cartridge as claimed in claim 1 further comprising the step of determining the velocities of droplets ejected from said ink ejection nozzles of said printhead in response to control signals based on said revised energy requirements and wherein said step of determining revised energy requirements for said ink ejection nozzles is further based on the velocities of droplets ejected in response to said control signals, said revised energy requirements making the velocities of ink droplets ejected from said ink ejection nozzles substantially uniform.

3. A method for customizing control of a print cartridge to improve quality of print produced using said print cartridge which includes a cartridge body containing ink and a printhead secured to said cartridge body and defining ink ejection nozzles, said method comprising the steps of:

determining resistance values of nozzle control paths on said print cartridge, said nozzle control paths corresponding to said ink ejection nozzles of said printhead;

determining energy requirements for said ink ejection nozzles based on said resistance values so that ink is ejected substantially uniformly from said ink ejection nozzles;

determining the velocities of droplets ejected from said ink ejection nozzles of said printhead in response to control signals based on said energy requirements;

determining revised energy requirements for said ink ejection nozzles based on the velocities of droplets ejected in response to said control signals, said energy requirements making the velocities of ink droplets ejected from said ink ejection nozzles substantially uniform; and storing said revised energy requirements as energy requirements specific to said print cartridge in a memory device mounted on said print cartridge.

4. A method for customizing control of a print cartridge to improve quality of print produced using said print cartridge which includes a cartridge body containing ink and a printhead secured to said cartridge body and defining ink ejection nozzles, said method comprising the steps of:

determining nominal energy requirements for control of said print cartridge to eject ink droplets from said ink ejection nozzles;

determining resistance values of nozzle control paths on said print cartridge, said nozzle control paths corresponding to said ink ejection nozzles of said printhead;

determining first adjusted energy requirements for said ink ejection nozzles based on said resistance values;

determining masses of droplets ejected from said ink ejection nozzles of said printhead in response to control signals based on said first adjusted energy requirements;

determining second adjusted energy requirements for said ink ejection nozzles based on said masses of droplets ejected in response to said control signals based on said first adjusted energy requirements; and storing said second adjusted energy requirements as energy requirements specific to said print cartridge in a memory device mounted on said print cartridge so that a printer can retrieve said energy requirements for control of said print cartridge.

5. A method for customizing control of a print cartridge as claimed in claim 4 wherein said step of storing said second adjusted energy requirements as energy requirements specific to said print cartridge comprises the step of storing said second adjusted energy requirements as adjusted pulsewidths.

6. A method for customizing control of a print cartridge as claimed in claim 4 wherein said step of storing said second adjusted energy requirements as energy requirements specific to said print cartridge comprises the step of storing said second adjusted energy requirements as offsets from nominal pulsewidths.

7. A method for customizing control of a print cartridge as claimed in claim 4 further comprising the steps of:

determining velocities of droplets ejected from said ink ejection nozzles of said printhead in response to control signals based on said second adjusted energy requirements;

determining third adjusted energy requirements for said ink ejection nozzles based on said velocities of droplets ejected from said ink ejection nozzles of said printhead in response to control signals based on said second adjusted energy requirements; and storing said third adjusted energy requirements as said energy requirements specific to said print cartridge in said memory device mounted on said print cartridge.

8. A method for customizing control of a print cartridge as claimed in claim 7 wherein said step of storing said third adjusted energy requirements as energy requirements specific to said print cartridge comprises the step of storing said third adjusted energy requirements as adjusted pulsewidths.

9. A method for customizing control of a print cartridge as claimed in claim 7 wherein said step of storing said third adjusted energy requirements as energy requirements specific to said print cartridge comprises the step of storing said third adjusted energy requirements as offsets from nominal pulsewidths.

10. A method for customizing control of a print cartridge to improve quality of print produced using said print cartridge which includes a cartridge body containing ink and a printhead secured to said cartridge body and defining ink ejection nozzles, said method comprising the steps of:

determining nominal energy requirements for control of said print cartridge to eject ink droplets from said ink ejection nozzles;

determining resistance values of nozzle control paths on said print cartridge, said nozzle control paths corresponding to said ink ejection nozzles of said printhead;

determining resistance adjusted energy requirements for said ink ejection nozzles based on said resistance values;

determining velocities of droplets ejected from said ink ejection nozzles of said printhead in response to control signals based on said first adjusted energy requirements;

determining velocity adjusted energy requirements for said ink ejection nozzles based on said velocities of droplets ejected in response to said control signals based on said first adjusted energy requirements; and storing said velocity adjusted energy requirements as energy requirements specific to said print cartridge in a memory device mounted on said print cartridge so that a printer can retrieve said energy requirements for control of said print cartridge.

11. A method for customizing control of a print cartridge as claimed in claim 10 wherein said step of storing said velocity adjusted energy requirements as energy requirements specific to said print cartridge comprises the step of storing said velocity adjusted energy requirements as adjusted pulsewidths.

12. A method for customizing control of a print cartridge as claimed in claim 10 wherein said step of storing said velocity adjusted energy requirements as energy requirements specific to said print cartridge comprises the step of storing said velocity adjusted energy requirements as offsets from nominal pulsewidths.

13. A method for customizing control of a print cartridge as claimed in claim 10 further comprising the steps of:

determining masses of droplets ejected from said ink ejection nozzles of said printhead in response to control signals based on said velocity adjusted energy requirements;

determining mass adjusted energy requirements for said ink ejection nozzles based on said masses of droplets ejected from said ink ejection nozzles of said printhead in response to control signals based on said velocity adjusted energy requirements; and storing said mass adjusted energy requirements as said energy requirements specific to said print cartridge in said memory device mounted on said print cartridge.

14. A method for customizing control of a print cartridge as claimed in claim 13 wherein said step of storing said mass adjusted energy requirements as energy requirements specific to said print cartridge comprises the step of storing said mass adjusted energy requirements as adjusted pulsewidths.

15. A method for customizing control of a print cartridge as claimed in claim 13 wherein said step of storing said mass adjusted energy requirements as energy requirements specific to said print cartridge comprises the step of storing said mass adjusted energy requirements as offsets from nominal pulsewidths.

* * * * *